US008347845B2

(12) United States Patent
Ogawa et al.

(10) Patent No.: US 8,347,845 B2
(45) Date of Patent: Jan. 8, 2013

(54) ENGINE OIL FILTER AND COOLING SYSTEM

(75) Inventors: Kazuhisa Ogawa, Wako (JP); Kentaro Sugimura, Wako (JP); Hiroaki Hasebe, Wako (JP); Kouhei Arakawa, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 790 days.

(21) Appl. No.: 12/484,428

(22) Filed: Jun. 15, 2009

(65) Prior Publication Data

US 2009/0314245 A1 Dec. 24, 2009

(30) Foreign Application Priority Data

Jun. 18, 2008 (JP) ..... 2008-159608

(51) Int. Cl.
*F01M 5/00* (2006.01)
*F01M 11/03* (2006.01)

(52) U.S. Cl. ..... 123/196 AB; 184/104.3; 210/167.06

(58) Field of Classification Search ..... 123/41.33, 123/196 R, 196 A, 196 AB; 184/6.22, 6.24, 184/104.3; 210/168, 170, 171, 184, 186, 210/444; 165/916
See application file for complete search history.

(56) References Cited

U.S. PATENT DOCUMENTS

| | | | |
|---|---|---|---|
| 5,351,664 | A | 10/1994 | Rotter et al. |
| 6,811,686 | B1 | 11/2004 | Sorce |
| 2006/0219208 | A1 | 10/2006 | Chonan et al. |

FOREIGN PATENT DOCUMENTS

| | | | |
|---|---|---|---|
| EP | 1503050 | A2 | 2/2005 |
| GB | 2 232 204 | A | 12/1990 |
| JP | 58-136613 | U | 9/1983 |
| JP | 59-103066 | U | 7/1984 |
| JP | 59-110310 | U | 7/1984 |
| JP | 2-163405 | A | 6/1990 |
| JP | 2-147809 | U | 12/1990 |
| JP | 06-185333 | A | 7/1994 |
| JP | 10-077818 | A | 3/1998 |
| JP | 2004-513283 | A | 4/2004 |
| JP | 2004-346889 | A | 12/2004 |
| JP | 2007-270691 | A | 10/2007 |

OTHER PUBLICATIONS

European Search Report dated Nov. 17, 2009, issued in corresponding European Patent Application No. 09251581.
European Office Action dated Aug. 12, 2011, issued in corresponding European Patent Application No. 09251581.6.

(Continued)

*Primary Examiner* — Noah Kamen
(74) *Attorney, Agent, or Firm* — Westerman, Hattori, Daniels & Adrian, LLP

(57) ABSTRACT

In an engine oil filter system in which: a filter-attachment base is joined to one side surface of an engine; and an oil filter which filters lubricating oil supplied to the engine from an oil pump is attached to the filter-attachment base, an oil cooler for cooling down the lubricating oil transferred between the engine and the oil filter is formed integrally with the filter-attachment base. Accordingly, it is possible to provide an inexpensive engine oil filter system which includes an oil cooler constituted by utilizing a filter-attachment base, and which thus eliminates the need to modify an oil filter and also the need to form, on an engine, an attachment portion to which the oil cooler is exclusively attached.

2 Claims, 5 Drawing Sheets

OTHER PUBLICATIONS

Japanese Office Action dated Jan. 11, 2012, issued in corresponding Japanese Patent Application No. 2008-159608.

European Office Action dated Mar. 22, 2012, issued in corresponding European Patent Application No. 09251581.6.

Japanese Office Action dated Sep. 19, 2012, issued in corresponding Japanese Patent Application No. 2008-159608 (3 pages).

ENGINE OIL FILTER AND COOLING SYSTEM

BACKGROUND OF THE INVENTION

1. Field of the Invention

The present invention relates to an engine oil filter system comprising: a filter-attachment base joined to one side surface of an engine; and an oil filter attached to the filter-attachment base, the oil filter filtering lubricating oil supplied to the engine from an oil pump, and, especially, relates to an oil filter system with an oil cooler.

2. Description of the Related Art

An engine oil filter system including an oil filter attached to a side surface of an engine with a filter-attachment base interposed therebetween has already been known as disclosed, for example, in Japanese Patent Application Laid-open No. 2007-270691.

In addition, the following two techniques have been known that each provide an engine with an oil cooler for cooling down lubricating oil: a technique that integrates an oil cooler in an oil filter (refer to Published Japanese Translation No. 2004-513283 of PCT/US2001/045617); and a technique that separately attaches an oil cooler to an engine.

The technique that integrates an oil cooler in an oil filter requires a considerable modification of the structure, which is complex, of the oil filter itself, in turn leading to a significant increase in the manufacturing cost by necessity. On the other hand, the technique that separately attaches an oil cooler to an engine requires that an attachment portion to which an oil cooler is exclusively attached be formed on an engine, and thus is very limited in terms of layout.

SUMMARY OF THE INVENTION

The present invention has been made in view of the above-described circumstances. An object of the present invention is thus to provide an inexpensive engine oil filter system which includes an oil cooler constituted by utilizing a filter-attachment base, and which thus eliminates the need to modify an oil filter and also the need to form, on an engine, an attachment portion to which the oil cooler is exclusively attached.

In order to achieve the object, according to a first feature of the present invention, there is provided an engine oil filter system comprising: a filter-attachment base joined to one side surface of an engine; an oil filter attached to the filter-attachment base, the oil filter filtering lubricating oil supplied to the engine from an oil pump; and an oil cooler formed integrally with the filter-attachment base, the oil cooler cooling down the lubricating oil transferred between the engine and the oil filter.

According to the first feature of the present invention, the oil cooler for cooling oil is formed integrally with the filter-attachment base. For this reason, a conventional general oil filter can be used as it is. In addition, it is possible to cool down the lubricating oil for the engine with no need to provide the engine with an attachment portion to which the oil cooler is exclusively attached. Consequently, the oil cooler can be provided at a low cost.

According to a second feature of the present invention, in addition to the first feature, the oil cooler comprises: a cooler tower formed integrally with the filter-attachment base so as to protrude from one side of the filter-attachment base; a bent oil passage provided inside the cooler tower so that the oil transferred between the engine and the oil filter passes through the bent oil passage; and a large number of radiator fins provided in a protruding manner on an outer periphery of the cooler tower.

According to the second feature of the present invention, the oil can be effectively cooled down with a heat radiation effect of the radiator fins during passing through the relatively-long bent oil passage in the cooler tower.

According to a third feature of the present invention, in addition to the first or second feature, the oil filter and the oil cooler are arranged radially around the filter-attachment base.

According to the third feature of the present invention, the assembly of the filter-attachment base, the oil filter, and the oil cooler can be compactly constituted, and the assembly can be compactly arranged along one side surface of the engine.

The above description, other objects, characteristics and advantages of the present invention will be clear from detailed descriptions which will be provided for the preferred embodiment referring to the attached drawings.

DESCRIPTION OF THE PREFERRED EMBODIMENT

An embodiment of the present invention will be explained below based on the attached drawings.

Figure 1:
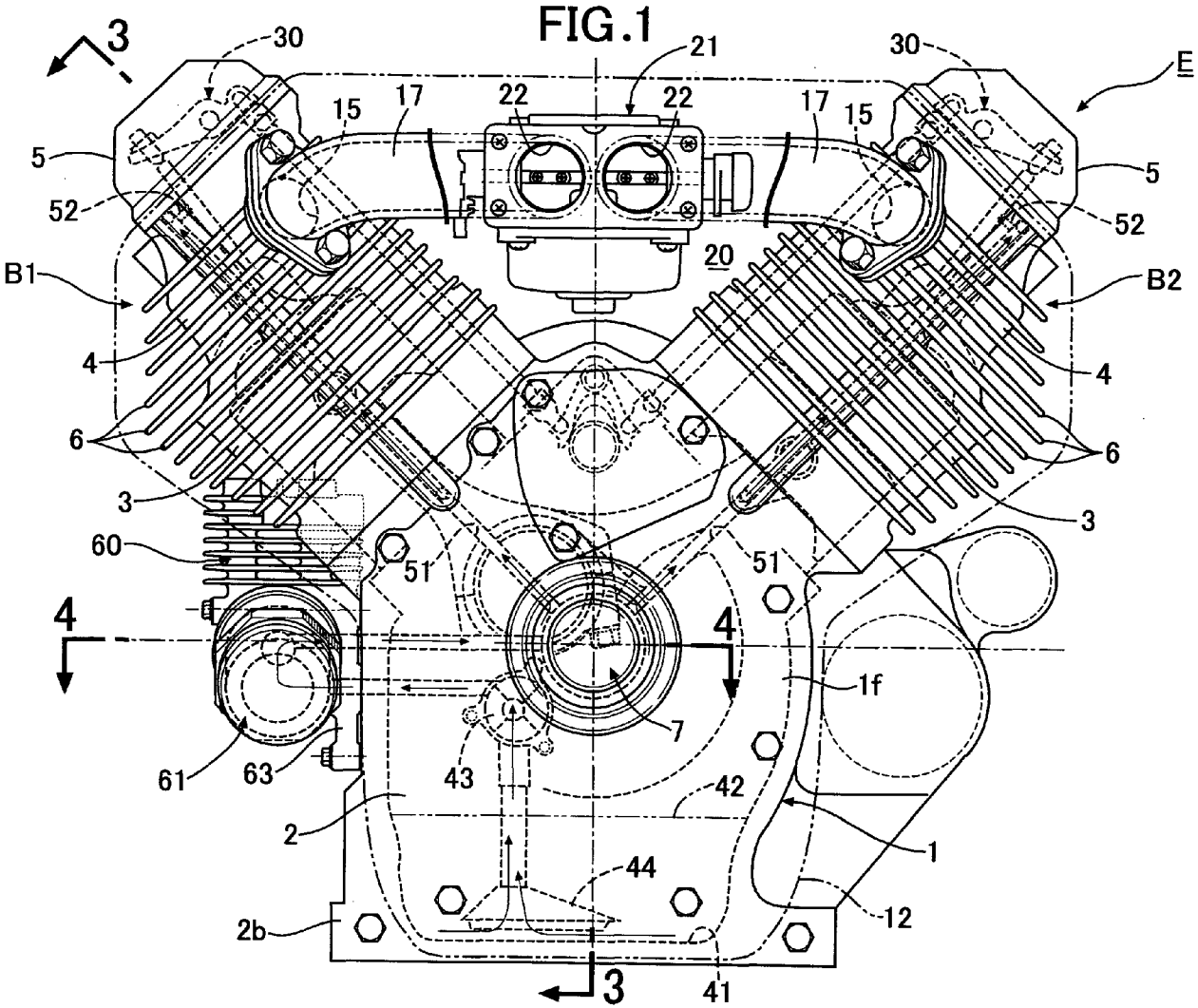
FIG. 1 is a front view showing an air-cooled general-purpose V-type general-purpose engine equipped with an oil filter of an embodiment of the present invention with a cooling fan removed (a cross-sectional view taken along a line 1-1 in FIG. 3)
Figure 2:
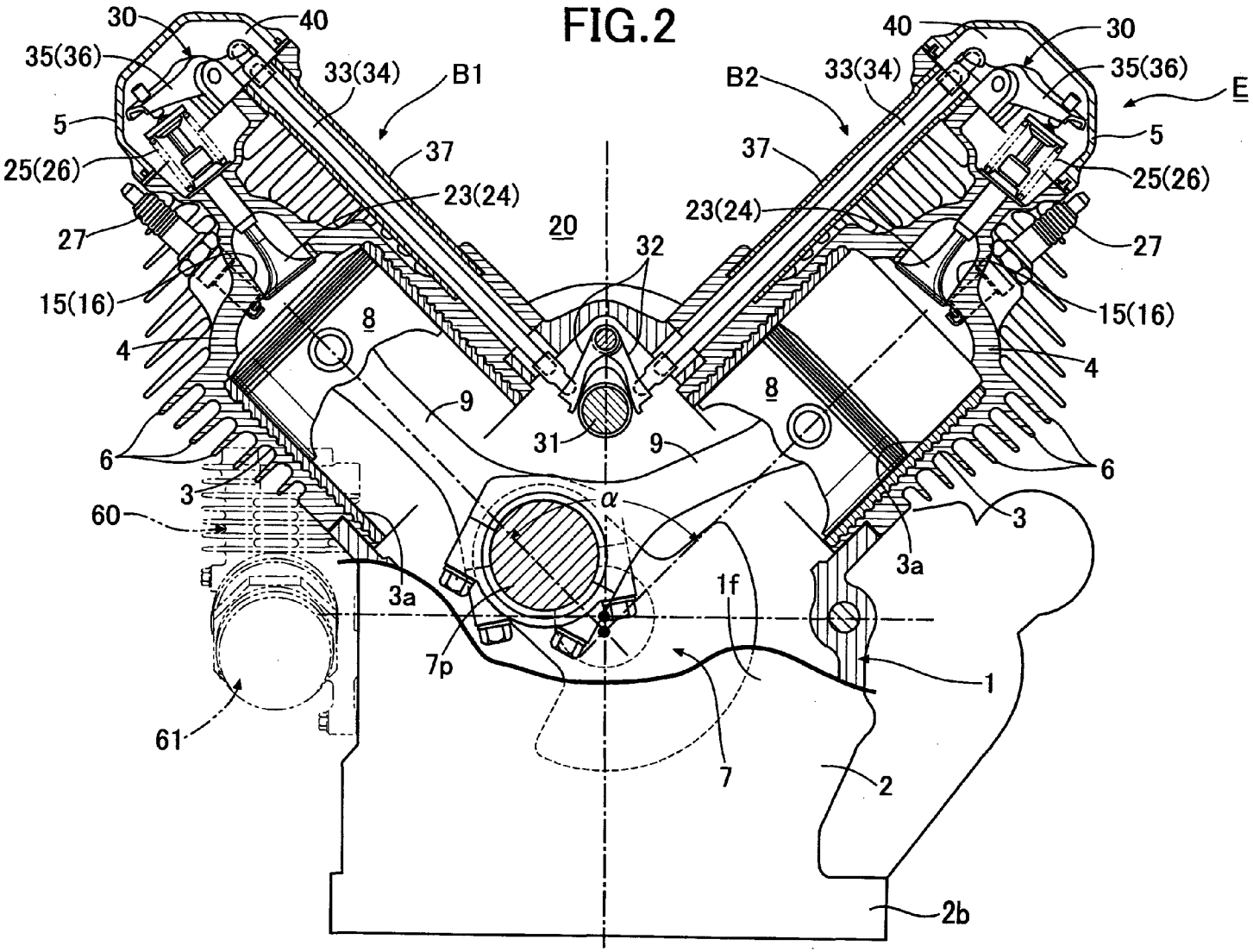
FIG. 2 is a longitudinal cross-sectional front view of an essential part of the same general-purpose engine (a cross-sectional view taken along a line 2-2 in FIG. 3)

Firstly, in FIGS. 1 and 2, an engine body 1 of an air-cooled general-purpose V-type general-purpose engine includes: a crankcase 2; a first bank B1 and a second bank B2 which are arranged respectively on the left and right sides in a V-shape, and which are connected to an upper portion of the crankcase 2; and an installation flange 2*b* formed in a bottom portion of the crankcase 2. The first and second banks B1 and B2 are arranged in such a manner that the included angle a between the banks B1 and B2 is set at 90°.

Each of the first and second banks B1 and B2 includes: a cylinder block 3 which has a cylinder bore 3*a*, and which is bolt-coupled to the crankcase 2; and a cylinder head 4 which has a combustion chamber 4*a* leading to the cylinder bore 3*a*, and which is integrally connected to the cylinder block 3. A head cover 5 is bolt-coupled to an end surface of the cylinder head 4. Each of the first and second banks B1 and B2 is integrally molded, and has a large number of cooling fins 6 integrally formed to protrude from an outer surface of the bank.

Figure 3:
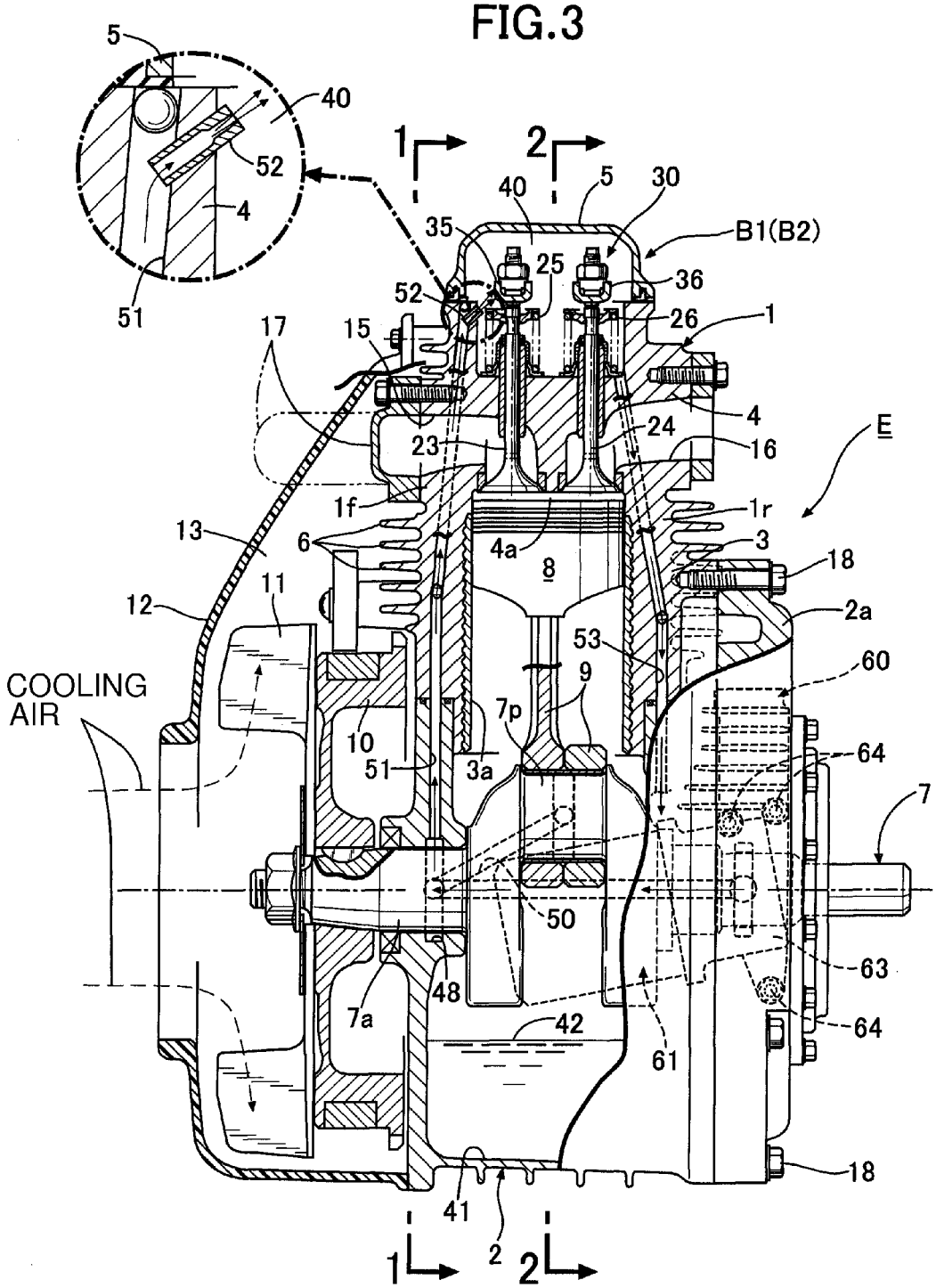
FIG. 3 is a cross-sectional view taken along a line 3-3 in FIG. 1.
Figure 4:
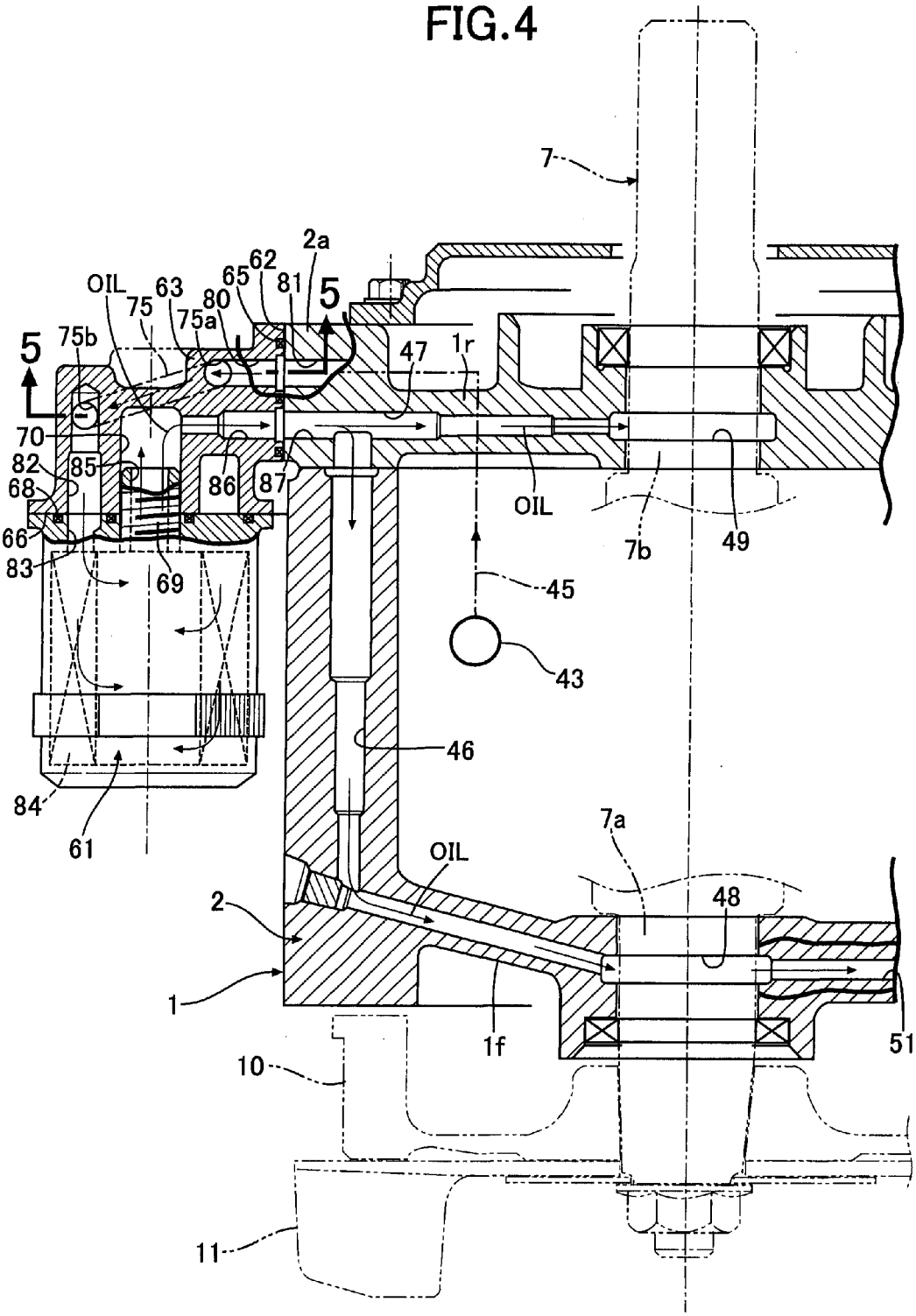
FIG. 4 is a cross-sectional view taken along a line 4-4 in FIG. 1.

As shown in FIGS. 3 and 4, the crankcase 2 supports a pair of front and rear journal portions 7*a* and 7*b* of a crankshaft 7 respectively at front and rear end walls of the crankcase 2. Pistons 8, which are fitted respectively into cylinder bores 3*a* of the first and second banks B1 and B2, are each continuously connected to a crankpin 7*p* of the crankshaft 7 with a connecting rod 9 interposed therebetween.

A cooling fan 11 is fixed, together with a flywheel 10, to one end portion, protruding out from a front surface of the crankcase 2, of the crankshaft 7. A shroud 12 is attached to a front surface of the engine body 1. While the cooling fan 11 draws an outside air, the shroud 12 guides, as a cooling air, the outside air to the surroundings of the banks B1 and B2 as well as the surrounding of a carburetor 21, which will be described later. In other words, the shroud 12 defines a cooling-air passage 13 between the shroud 12 and the front surface of the engine body 1. The cooling air is thus supplied through the cooling-air passage 13 to the surroundings of the banks B1 and B2 as well as of the carburetor 14.

Hereinafter, one end wall of the engine body 1 on the cooling-air passage 13 side is referred to as a front end wall 1*f*, and the other end wall opposite to the front end wall 1*f* is referred to as a rear end wall 1*r*. On the rear end wall 1*r* side, a bearing wall 2*a*, which supports the output-side end portion of the crankshaft 7, of the crankcase 2, is formed separately from the main part of the crankcase 2, and is detachably joined to the main part with a plurality of bolts 18.

In FIGS. 1 and 2 again, intake and exhaust ports 15 and 16 opening to the combustion chamber 4*a* are formed in each of the cylinder heads 4, 4 of the respective first and second banks B1 and B2. An upstream end of each intake port 15 opens on the front surface side of the corresponding cylinder head 4. Intake pipes 17, 17 are fixed respectively to the cylinder heads 4, 4, and twin carburetor 21 is arranged in a center portion of a valley portion 20 between the first and second banks B1 and B2. The intake ports 15, 15 of the first and second banks B1 and B2 communicate respectively with intake passages 22, 22 of the twin carburetor 21 through the corresponding intake pipes 17, 17.

Next, in FIGS. 2 and 3, intake and exhaust valves 23 and 24, which open and close the intake port 15 and the exhaust port 16, respectively, are attached to each of the cylinder heads 4, 4 of the first and second banks B1 and B2. Valve springs 25 and 26 are mounted respectively on the intake and exhaust valves 23 and 24 so as to urge the corresponding valves 23 and 24 in a valve-closing direction. In addition, an ignition plug 27 having an electrode exposed to the combustion chamber 4*a* is screwed into each of the cylinder heads 4.

A valve operating system 30 for opening and closing the intake and exhaust valves 23 and 24 in each of the first and second banks B1 and B2 is laid from the crankcase 2 to the corresponding cylinder head 4 of one of the first and second banks B1 and B2. The valve operating systems 30 include a camshaft 31 rotatably supported by the front and rear end walls of the crankcase 2 in parallel with, and directly above, the crankshaft 7. The camshaft 31 is driven at a speed reduction ratio of 1/2 by the crankshaft 7 via an unillustrated timing transmission system. The camshaft 31 includes intake and exhaust cams integrally formed therewith. The intake and exhaust cams are continuously connected respectively to intake and exhaust push rods 33 and 34 in each of the banks B1 and B2 via cam followers 32 pivotally supported by the crankcase 2, and further respectively to the intake and exhaust valves 23 and 24 via intake and exhaust rocker arms 35 and 36 pivotally supported by the corresponding cylinder head 4. The intake and exhaust push rods 33 and 34 are housed in a tubular rod cover 37 arranged along a side surface, on the valley portion 20 side, of each of the banks B1 and B2.

The valve operating systems 30 are constituted as described above. Each valve operating system 30 opens and closes the intake and exhaust valves 23 and 24 in cooperation with the valve springs 25 and 26 in accordance with intake and exhaust strokes of the piston 8 in the corresponding one of the banks B1 and B2.

In each of the banks B1 and B2, the intake and exhaust rocker arms 35 and 36 are housed in a valve operating chamber 40 defined between the cylinder head 4 and head cover 5. The valve operating chamber 40 communicates with the inside of the crankcase 2 through a hollow portion of the corresponding rod cover 37.

Next, a lubricating system for the general-purpose engine E will be described with reference to FIGS. 1 and 3 to 5.

In FIGS. 1 and 3, a bottom portion of the crankcase 2 is formed into an oil reservoir 41 for reserving lubricating oil 42. The oil 42 is pumped up through an oil strainer 44 by an oil pump 43 driven by the crankshaft 7, and then is sent with pressure to an oil cooler 60 and an oil filter 61.

As shown in FIG. 4, a base-attachment surface 62 is formed in an outer surface, in the radial direction, of the bearing wall 2*a* of the crankcase 2. A filter-attachment base 63 is detachably joined to the base-attachment surface 62 with a plurality of bolts 64 with a seal member 65 interposed therebetween. In addition, a filter-attachment surface 66 is formed in the filter-attachment base 63 in such a way as to be substantially at right angles to the base-attachment surface 62 and to face to the front side of the engine E, that is, to the cooling fan 11 side. The cylindrical oil filter 61 is detachably attached to the filter-attachment surface 66 with a seal member 68 interposed therebetween. A hollow attachment screw shaft 69 protrudes from a center portion of the oil filter 61, while an attachment screw hole 70 opens in the filter-attachment surface 66. The oil filter 61 is attached to the filter-attachment surface 66 with the hollow attachment screw shaft 69 screwed into and fastened to the attachment screw hole 70. In this manner, the cylindrical oil filter 61 is disposed with a head portion thereof directed to the front of the engine E.

Figure 5:
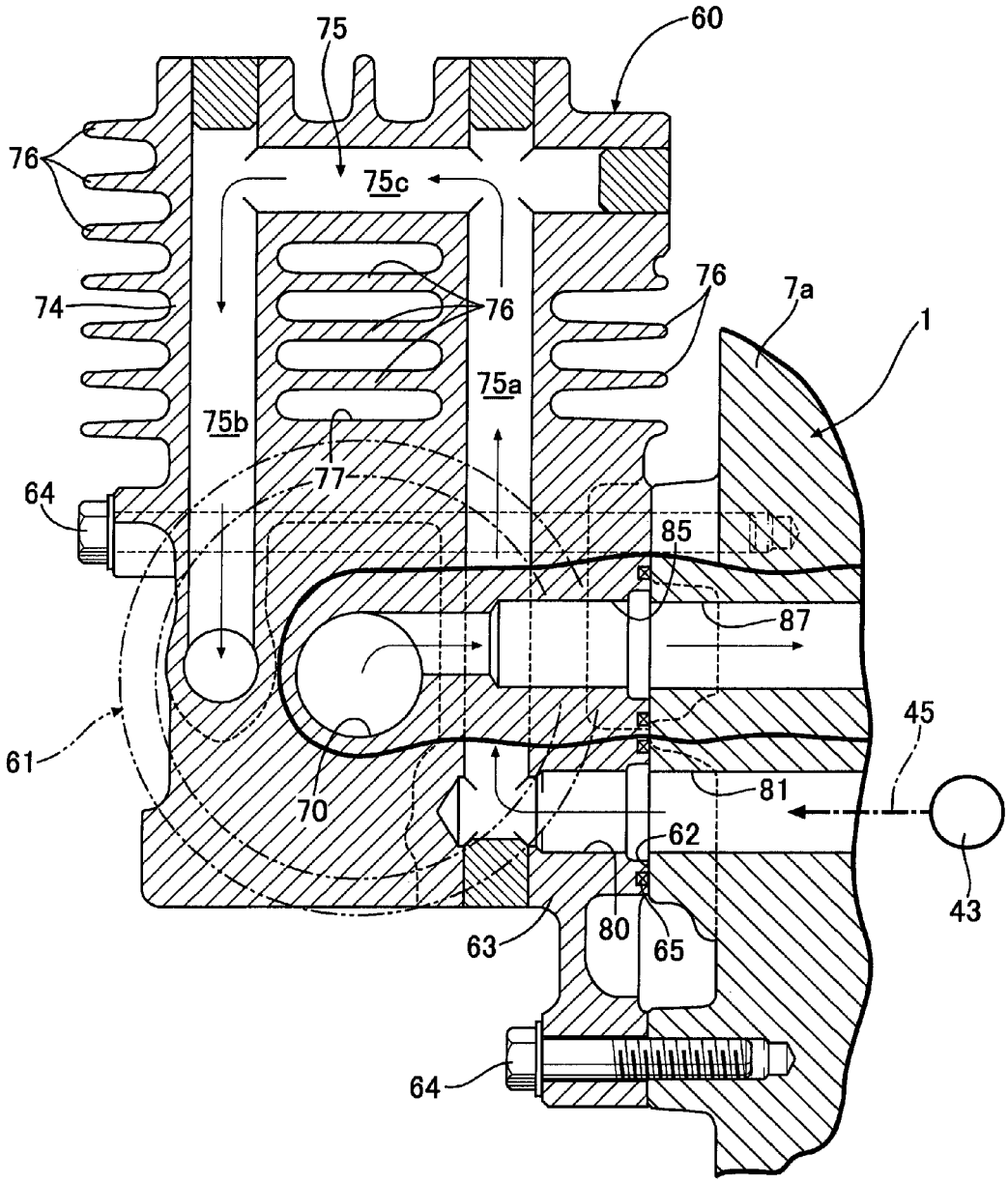
FIG. 5 is a cross-sectional view taken along a line 5-5 in FIG. 4.

On the other hand, as shown in FIGS. 3 and 5, a cooler tower 74 is formed integrally with the filter-attachment base 63 so as to extend in a direction different from that in which the oil filter 61 extends. A bent oil passage 75 which is bent in a U-shape is provided inside the cooler tower 74. In addition, a large number of radiator fins 76 surrounding the bent oil passage 75 are formed integrally on the outer peripheral surface of the cooler tower 74.

The bent oil passage 75 is formed, in the U-shape, of: two straight passages 75*a* and 75*b* extending in parallel with each other; and a middle passage 75*c* connecting one end portions of the respective straight passages 75*a* and 75*b* to each other. A ventilation hole 77 penetrating a region between the straight passages 75*a* and 75*b* is provided in the cooler tower 74, and the radiator fins 76 extend onto an inner peripheral surface of the ventilation hole 77. These radiator fins 76 are arranged in parallel with a direction in which the cooling air sent with pressure from the cooling fan 11 flows.

The oil cooler 60 is thus formed of the cooler tower 74, the bent oil passage 75, and the radiator fins 76. The oil cooler 60 and the oil filter 61 are radially arranged around the filter-attachment base 63 (see FIG. 3).

An inlet port 80 is formed in the filter-attachment base 63. The inlet port 80 leads to the one straight passage 75*a* of the bent oil passage 75, and opens toward the base-attachment surface 62 of the bearing wall 2*a*. An outlet port 81 of an engine lubricating oil passage opens in the base-attachment surface 62, and the inlet port 80 is designed to overlap, and communicate with, the outlet port 81. In addition, an annular oil passage 82 is formed in the filter-attachment base 63. The annular oil passage 82 communicates with the other straight passage 75*b* of the bent oil passage 75, and opens in the filter-attachment surface 66. An inlet port 83 of the oil filter 61 is designed to overlap, and communicate with, a part of the annular oil passage 82. Oil flowing into the inlet port 83 is filtered by a filter element 84 disposed inside the oil filter 61, and then flows to the screw hole 70 in the filter-attachment base 63 through a hollow portion of the attachment screw shaft 69. Accordingly, the hollow portion of the attachment screw shaft 69 serves as an outlet port 85 of the oil filter 61.

Further, an outlet port 86 is formed in the filter-attachment base 63. The outlet port 86 communicates with the screw hole 70, and opens toward the base-attachment surface 62. The outlet port 86 is designed to overlap, and communicate with, an inlet port 87, opening in the base-attachment surface 62, of the engine lubricating oil passage.

In FIG. 4, an ejecting oil passage 45, a first branched oil passage 46, and a second branched oil passage 47 are formed in the crankcase 2. The ejecting oil passage 45 extends from an ejecting port of the oil pump 43 to reach the outlet port 81. The first branched oil passage 46 extends from the inlet port 87 to reach a first annular groove 48 surrounding the front journal portion 7*a* of the crankshaft 7. The second branched oil passage 47 extends from the same inlet port 87 to reach a second annular groove 49 surrounding the rear journal portion 7*b* of the crankshaft 7.

In FIGS. 3 and 4, a pair of left and right supply oil passages 51, 51 (only one of which is illustrated in FIG. 3) are formed in the front end wall 1*f*, facing the cooling-air passage 13, of the engine body 1. The left and right supply oil passages 51, 51 extend from the first annular oil groove 48 respectively to the valve operating chambers 40 of the first and second banks B1 and B2. Jets 52 for injecting oil to the valve operating systems 30 inside the valve operating chambers 40 are provided to opening portions, to the corresponding valve operating chambers 40, of the respective supply oil passages 51. The inner diameter of the jets 52 is set to be sufficiently smaller than the inner diameter of the supply oil passages 51.

On the other hand, a pair of left and right return oil passages 53, 53 (only one of which is illustrated in FIG. 3) are formed in the rear end wall 1*r* of the engine body 1. Oil in the lower portion of the valve operating chamber 40 in each of the banks B1 and B2 is returned to the oil reservoir 41 in the crankcase 2 through the corresponding return oil passage 53.

Next, an operation of the embodiment will be explained.

During the operation of the engine E, the oil pump 43 driven by the crankshaft 7 pumps up the oil 42 in the oil reservoir 41 through the oil strainer 44, and sends with pressure the oil 42 to the inlet port 80 of the filter-attachment base 63 through the ejecting oil passage 45 and the outlet port 81. The oil thus sent with pressure to the inlet port 80 flows to the cooler tower 74, and is effectively cooled down with the heat radiation effect of the radiator fins 76 on the cooling air during passing through the long bent oil passage 75.

The oil thus cooled down is transported to the inlet port 83 of the oil filter 61 through the annular oil passage 82 of the filter-attachment base 63. After being filtered by the filter element 84 as described above, the oil is supplied to the inlet port 87 of the crankcase 2 through the outlet port 85 of the oil filter 61, the screw hole 70 and the outlet port 86 of the filter-attachment base 63. In this way, the oil ejected from the oil pump 43 is cooled down, filtered, and thereafter, supplied to the engine E.

The oil thus flowing into the inlet port 87 of the crankcase 2 is divided into parts flowing respectively into the first and second branched oil passages 46 and 47 so as to be supplied to the corresponding first and second annular grooves 48 and 49. Consequently, the front and rear journal portions 7*a* and 7*b* of the crankshaft 7 are lubricated with the oil. Moreover, the oil used for lubricating the journal portion 7*a* is supplied further to the crankpins 7*p* through an oil hole 50 formed in the crankshaft 7, so that the surrounding of the crankpins 7*p* is lubricated with the oil.

Further, the part of the oil supplied to the first annular groove 48 on the front side is supplied to the supply oil passage 51 in each of the first and second banks B1 and B2, and is injected into each valve operating chamber 40 from the corresponding jet 52. The oil thus injected into the valve operating chamber 40 is misted, so that the intake and exhaust valves 23 and 24 as well as each part of the valve operating system 30 inside the valve operating chamber 40 can be favorably lubricated.

Furthermore, the supply oil passage 51 in each of the banks B1 and B2 is formed in the front end wall 1*f*, facing the cooling-air passage 13, of the engine body 1. For this reason, the supply oil passage 51 is effectively cooled down together with the front end wall 1*f* by the cooling air sent with pressure from the cooling fan 11. Accordingly, an oil mist at an appropriate temperature can be generated in each valve operating chamber 40 in cooperation with a reduction in pressure due to the oil injection from the jet 52. As a result, it is possible not only to lubricate, but also to effectively cool down, the intake and exhaust valves 23 and 24 as well as the valve operating system 30.

After being used for lubricating each valve operating system 30, the oil is liquefied and reserved in the bottom portion of the valve operating chamber 40. The oil then flows down through the return oil passage 53 so as to return the oil reservoir 41 in the crankcase 2. With the above-described operation, the durability of the general-purpose engine E is improved, so that a harsh long-term stationary operation of the engine E is enabled.

In addition, each supply oil passage 51 and each return oil passage 53 are formed respectively in the front end wall 1*f* and the rear end wall 1*r* of the engine body 1 in a distributed manner. For this reason, the front end wall 1*f* and the rear end wall 1*r* can be prevented as much as possible from being reduced in strength due to the formation of the supply oil passages 51 and the return oil passages 53.

Meanwhile, in the lubricating system of such engine E, the oil filter 61 is attached to the filter-attachment base 63 joined to the bearing wall 2*a* of the crankcase 2, while the oil cooler 60 for cooling down the lubricating oil for the engine E is formed integrally with the filter-attachment base 63. For this reason, a conventional general oil filter can be used as it is as the oil filter 61. In addition, it is possible to cool down the lubricating oil for the engine E with no need to provide the engine body 1 with an attachment portion to which an oil cooler is exclusively attached. Consequently, the oil cooler 60 can be provided at a low cost.

In addition, in this regard, since the oil filter 61 and the oil cooler 60 are radially arranged around the filter-attachment base 63, the assembly of the filter-attachment base 63, the oil filter 61, and the oil cooler 60 can be compactly constituted. Moreover, the assembly can be compactly arranged along one side surface of the engine E.

Moreover, the base-attachment surface 62 for joining the filter-attachment base 63 is formed in the bearing wall 2*a*, which forms a part of the crankcase 2 but is a separate component from the main part of the crankcase 2. Accordingly, it is possible to easily process the base-attachment surface 62 in the bearing wall 2*a*, which is a relatively small component.

The embodiment of the present invention has been described in detail so far, various modifications in design may be made on the present invention without departing from the scope of the present invention. For example, the present invention may be applied to a single-cylinder or parallel multi-cylinder general-purpose engine.

What is claimed is:

1. An engine, comprising:

a crankcase;

a crankshaft extending between front and rear walls of the crankcase; and an engine oil filter system wherein the engine oil filter system includes, an oil filter adapted to filter lubricating oil supplied to the engine from an oil pump, and a filter-attachment base joined to one side surface of the engine at a base-attachment surface thereof, wherein the engine comprises a bearing wall which forms a part of the crankcase but is a separate component from a main part of the crankcase, the bearing wall forming the rear end wall of the crankcase and being located rearwardly of the main part of the crankcase, wherein the oil filter is attached to the filter-attachment base at a filter-attachment surface thereof, wherein the base-attachment surface for joining the filter-attachment base is formed in the bearing wall, wherein the filter-attachment surface is substantially at right angles to the base-attachment surface and faces the front side of the engine, wherein the engine oil filer system further comprises, an oil cooler formed integrally with the filter-attachment base, the oil cooler being adapted to cool down the lubricating oil transferred between the engine and the oil filter, and wherein the oil cooler includes, a cooler tower formed integrally with the filter-arrangement base so as to protrude from one side of the filter-attachment base in a direction different from that in which the oil filter extends, a bent oil passage provided inside the cooler tower so that the oil transferred between the engine and the oil filter passes through the bent oil passage, and a large number of radiator fins provided in a protruding manner on an outer periphery of the cooler tower, and wherein the engine comprises a cooling fan fixed to one end portion of the crankshaft, the end portion protruding out from the front wall of the crankcase, and wherein the radiator fins are oriented in parallel with a direction in which the cooling air sent with pressure from the cooling fan flows.

2. The engine according to claim 1, wherein the oil filter and the oil cooler are disposed radially around the filter-attachment base.

* * * * *